US005291709A

United States Patent [19]

Vranjesevic

[11] Patent Number: 5,291,709

[45] Date of Patent: Mar. 8, 1994

[54] UTILITY POLE SUPPORT ARRANGEMENT

[76] Inventor: George Vranjesevic, 302 Church St. Apt. 3H, White Plains, N.Y. 10603

[21] Appl. No.: 835,336

[22] Filed: Feb. 14, 1992

[51] Int. Cl.[5] ..... E02D 27/00

[52] U.S. Cl. ..... 52/297; 248/523

[58] Field of Search ..... 248/679, 523; 256/64; 52/294, 296, 297

[56] References Cited

U.S. PATENT DOCUMENTS

| | | | |
|---|---|---|---|
| 748,946 | 1/1904 | Hansberger | 52/297 |
| 1,284,565 | 11/1918 | Bennett, Jr. | 52/297 |
| 1,463,715 | 7/1923 | Muhlow | 52/297 |
| 1,553,785 | 9/1925 | Ley | 52/297 |
| 1,555,945 | 10/1925 | Cuttle et al. | 52/297 |
| 1,564,109 | 12/1925 | Ponsulle | 52/297 |
| 1,599,250 | 9/1926 | Schatz | 52/297 |
| 1,725,023 | 8/1929 | Stam | 52/297 |
| 1,753,063 | 4/1930 | Nitzsche | 52/297 |

FOREIGN PATENT DOCUMENTS

| | | | |
|---|---|---|---|
| 401607 | 7/1943 | Italy | 52/297 |

*Primary Examiner*—Blair M. Johnson
*Attorney, Agent, or Firm*—Leon Gilden

[57] ABSTRACT

First and second clamp members are arranged to secure a utility pole therebetween, with the utility pole in a spaced relationship relative to an underlying ground surface to prolong effective life of the associated utility pole. The clamp members each include a clamp base, with a clamp leg extending upwardly relative to the clamp base, with the clamp legs converging towards one another at an acute angle therebetween, with confronting semi-cylindrical clamping surfaces whose axes are coincident with a utility pole axis.

1 Claim, 4 Drawing Sheets

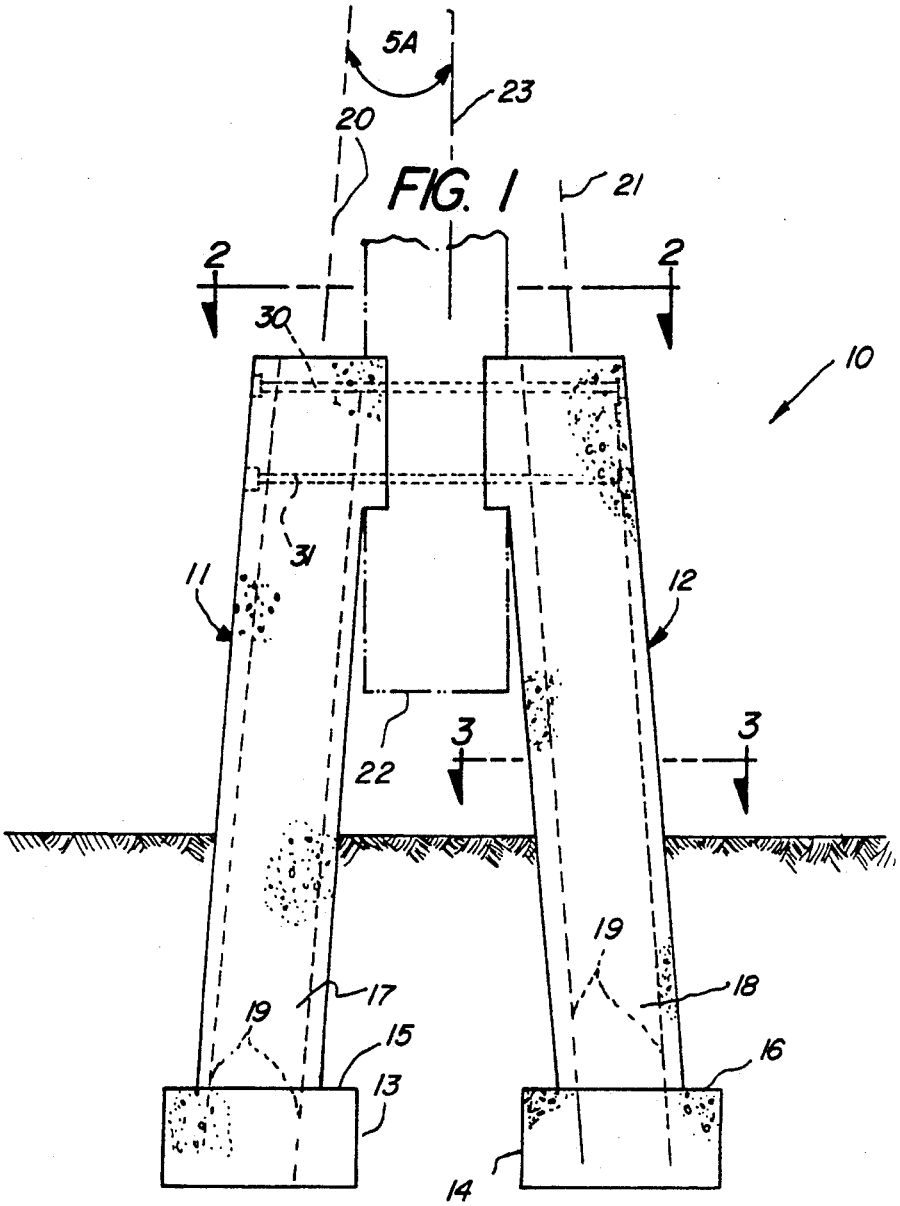
FIG. 1
FIG. 3
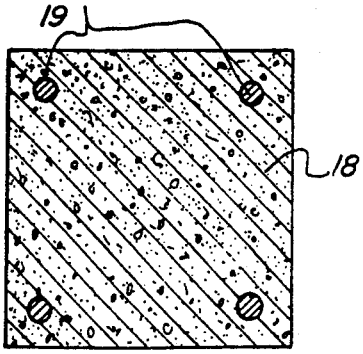

UTILITY POLE SUPPORT ARRANGEMENT

BACKGROUND OF THE INVENTION

1. Field of the Invention

The field of invention relates to utility pole support structure, and more particularly pertains to a new and improved utility pole support arrangement wherein the same is arranged to support and clamp a utility pole in a spaced relationship relative to an underlying ground surface.

2. Description of the Prior Art

Utility poles are typically mounted within an underlying ground surface, wherein in such an arrangement, damage by decay and pest infestation limits the effective life of an associated utility pole. The instant invention attempts to overcome deficiencies of the prior art by mounting the utility pole structure in a spaced relationship relative to an underlying ground surface. Prior art utility pole arrangements have heretofore failed to address this problem, such as exemplified in the U.S. Pat. No. 4,033,080 to Fukushiama wherein a concrete pole is arranged for connection to a wood pole at an upper distal end of the concrete pole. In this manner, the concrete pole forms a socket for positioning the wood pole above ground level.

U.S. Pat. No. 4,486,999 to Bayne sets forth a reinforcing star-like member arranged for securement into a utility pole to provide reinforcement for the pole to prolong pole life.

U.S. Pat. No. 4,892,601 to Norwood sets forth a utility pole repair arrangement, where a position around a utility pole and a hardenable composition directed into a volumetric area between the sleeve and the utility pole is arranged.

As such, it may be appreciated that there continues to be a need for a new and improved utility pole support arrangement as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of utility support structure now present in the prior art, the present invention provides a utility pole support arrangement wherein the same is arranged to mount and position a utility pole in a spaced relationship relative to an underlying ground surface. As such, the general purpose of the present invention, which will be described subsequently in greater detail, is to provide a new and improved utility pole support arrangement which has all the advantages of the prior art utility pole support structure and none of the disadvantages.

To attain this, the present invention provides first and second clamp members arranged to secure a utility pole therebetween, with the utility pole in a spaced relationship relative to an underlying ground surface to prolong effective life of the associated utility pole. The clamp members each include a clamp base, with a clamp leg extending upwardly relative to the clamp base, with the clamp legs converging towards one another at an acute angle therebetween, with confronting semi-cylindrical clamping surfaces whose axes are coincident with a utility pole axis.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved utility pole support arrangement which has all the advantages of the prior art utility pole support structure and none of the disadvantages.

It is another object of the present invention to provide a new and improved utility pole support arrangement which may be easily and efficiently manufactured and marketed.

It is a further object of the present invention to provide a new and improved utility pole support arrangement which is of a durable and reliable construction.

An even further object of the present invention is to provide a new and improved utility pole support arrangement which is susceptible of a low cost of manufacture with regard to both materials and labor, and which accordingly is then susceptible of low prices of sale to the consuming public, thereby making such utility pole support arrangements economically available to the buying public.

Still yet another object of the present invention is to provide a new and improved utility pole support arrangement which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic side view of the instant invention.

FIG. 3 is an orthographic view, taken along the lines 3—3 of FIG. 1 in the direction indicated by the arrows.

DESCRIPTION OF THE PREFERRED EMBODIMENT

Figure 2:
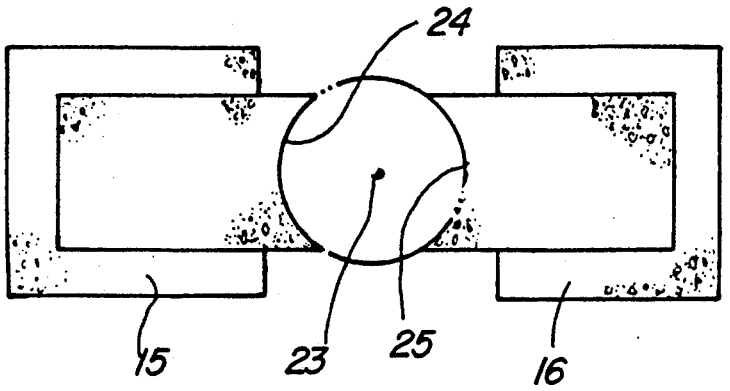
FIG. 2 is an orthographic view, taken along the lines 2—2 of FIG. 1 in the direction indicated by the arrows.
Figure 4:
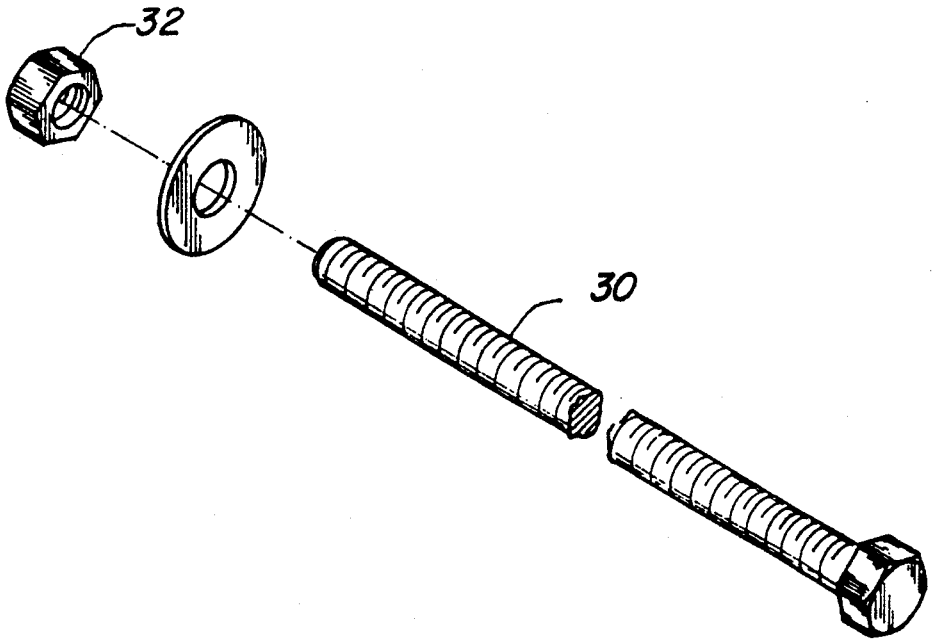
FIG. 4 is an isometric illustration of a fastener member utilized by the invention.
Figure 5:
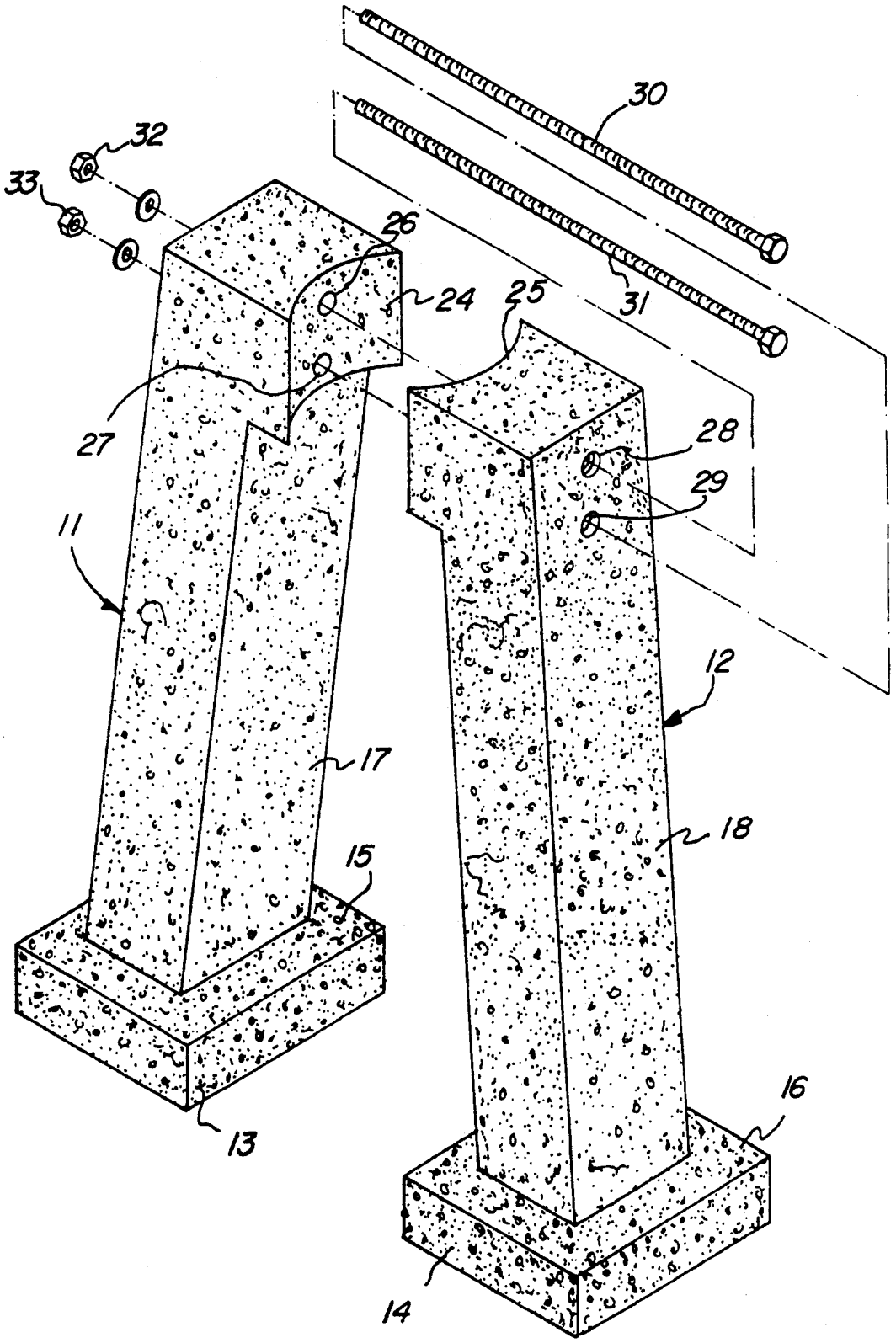
FIG. 5 is an isometric illustration of the invention.
Figure 6:
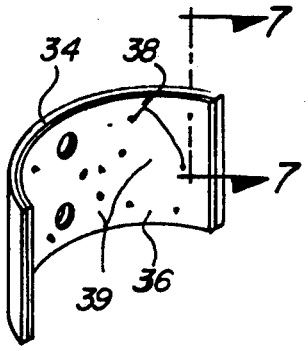
FIG. 6 is an isometric illustration of a liner structure utilized by each semi-cylindrical clamp saddle of the invention.
Figure 7:
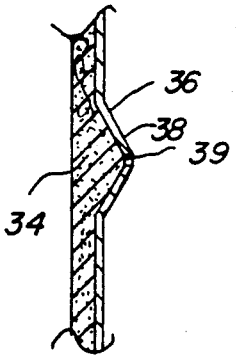
FIG. 7 is an orthographic view, taken along the lines 7—7 of FIG. 6 in the direction indicated by the arrows.
Figure 8:
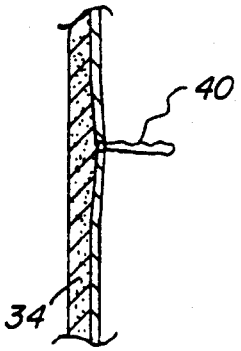
FIG. 8 is an orthographic view of the FIG. 7, with a compressed structure effecting expressing of the petroleum distillate through the associated apertures of the spikes of the shield structure.
Figure 9:
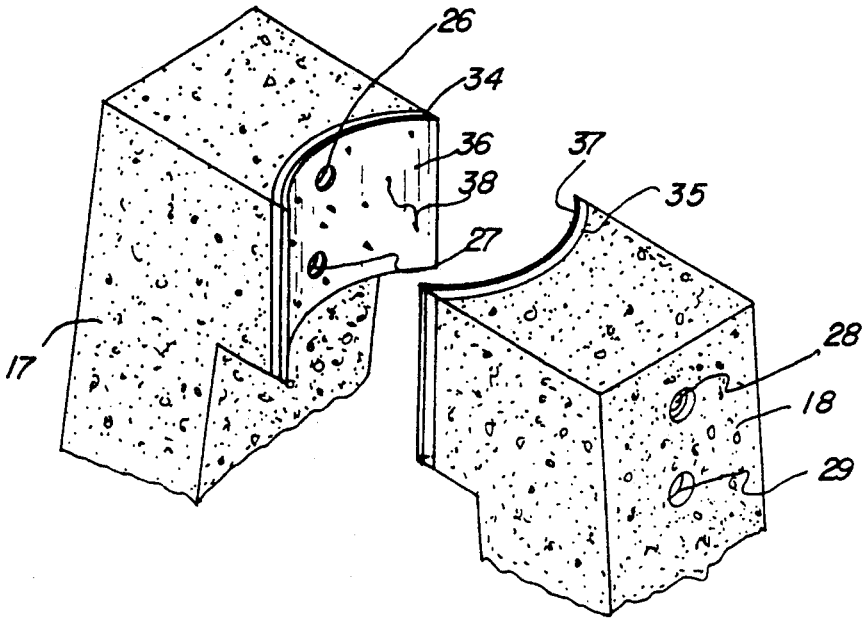
FIG. 9 is an isometric illustration of the liner and shield structure mounted within the clamp saddles of the invention.

With reference now to the drawings, and in particular to FIGS. 1 to 9 thereof, a new and improved utility pole and support arrangement embodying the principles and concepts of the present invention and generally designated by the reference numeral 10 will be described.

More specifically, the utility pole support arrangement 10 of the instant invention essentially comprises a first clamp member 11 positioned in adjacency relative to a second clamp member 12 to secure the utility pole 22 therebetween. The first clamp member 11 includes a first clamp base 13 positioned adjacent and in a spaced relationship relative to a second clamp base 14 of the second clamp member 12. The first and second clamp bases 13 and 14 are positioned within a subterranean orientation relative to a ground support surface, as illustrated in FIG. 1. A first clamp base top wall 15 is arranged substantially coplanar with a second clamp base top wall 16 to integrally mount a first clamp leg 17 and a second clamp leg 18 respectively to the first and second clamp base top walls 15 and 16. The first clamp leg 17 is defined about a first clamp leg axis 20, with the second clamp leg 18 defined about a second clamp leg axis 21. A plurality of parallel reinforcing rods 19, each parallel relative to one another, are arranged wherein a plurality of such reinforcing rods 19 extend longitudinally of each of the first and second clamp legs 17 and 18 extending into the first and second clamp bases 13 and 14 respectively of the first and second clamp legs 17 and 18. The reinforcing rod structure accommodates flexure and various ground shifting, such as freezing, thawing, and the like when mounted in the subterranean orientation, as illustrated in FIG. 1. The utility pole 22 clamped between the first and second clamp legs 17 and 18 is defined about a utility pole center line 23 that defines an acute angle relative to the intersecting first and second clamp leg axes 20 and 21. The first and second clamp leg axes 20 and 21 define an intersection relative to one another at an angle substantially equal to twice the acute angle oriented between the intersection of each leg axis 20 and 21 with the utility pole center line 23. As illustrated in the FIG. 1, the acute included angle "A" is substantially equal to "0.5A" in its orientation between a leg center line, such as leg center line 20 relative to the utility pole center line 23.

A first arcuate clamp saddle 24 and a second arcuate clamp saddle 25 are positioned in a mirror image confrontation relative to one another at upper distal ends of the respective first and second clamp legs 17 and 18. The first and second arcuate clamp leg saddles 24 and 25 each are of a semi-cylindrical configuration whose axis is coincident with the utility pole center line 23. The first clamp saddle 24 includes a respective first saddle first bore and a first saddle second bore 26 and 27 that are arranged in a parallel spaced relationship spaced apart a predetermined spacing. The second clamp saddle 25 includes a second clamp saddle first bore 28 and a second clamp saddle second bore 29 spaced apart the predetermined spacing in a parallel relationship. In this manner, the first saddle first bore 26 and the second saddle first bore 28 are coaxially aligned relative to one another, with the first saddle second bore 27 and the second saddle second bore 29 arranged in a coaxial relationship. The first and second saddle first bores 26 and 28 receive a first elongate clamp rod 30 therethrough, and the first saddle second bore 27 and the second saddle second bore 29 receive a second elongate clamp rod 31 therethrough. The first and second clamp rods 30 and 31 include first and second clamp rod fasteners 32 and 33 to secure the clamp rods in a tensioned relationship as they are directed in an orthogonal relationship relative to the utility pole center line 23 and to the utility pole to clamp the utility pole and the first and second clamp legs to the utility pole. In this manner, the utility pole is maintained in a rigid orientation above the ground surface in a spaced relationship to avoid penetration by moisture and insect infestation.

The FIGS. 6–9 illustrate the use of a tar or other petroleum distillate impregnated first and second liner 34 and 35 mounted coextensively to the respective first and second clamp plate saddles 24 and 25. The first and second liners 34 and 35 include a respective first and second arcuate metallic shield 36 and 37 mounted coextensively and complementarily to an outer surface of the respective first and second liners 34 and 35. Each of the metallic shields 36 and 37 include a matrix of clamp spikes 38 directed therethrough. The clamp spikes 38 project diametrically relative to the utility pole center line, and each of the spikes include an aperture 39 therethrough. Upon the clamping of the utility pole 23 between the first and second shields 36 and 37, the petroleum distillate or tar extrusion 40 is directed into communication with the utility pole outer surface, with a coating of the utility pole outer surface for enhanced protection at the interface of the clamp saddles 24 and 25 with the utility pole affording further protection to the utility pole minimizing the capturing of moisture and the like therethrough, as well as discouraging of insect infestation between the clamp saddles and the utility pole.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A utility pole support arrangement, comprising, a first clamp member positioned in confrontation with a second clamp member, and the first clamp member and the second clamp member arranged to secure a utility pole therebetween, with the first clamp member and the second clamp member arranged in a mirror image symmetrical relationship about an axis oriented between the first clamp member and the second clamp member, and the first clamp member including a first clamp base, the second clamp member including a second clamp base, and a first clamp leg integrally mounted to the first clamp base extending upwardly therefrom, and a second clamp leg integrally mounted to the second clamp base extending upwardly therefrom, wherein the first clamp leg and the second clamp leg define an acute angle therebetween and are canted towards the axis, and the first clamp leg defined along a first clamp leg axis, the second clamp leg defined along a second clamp leg axis, wherein an acute angle is defined between convergence of the first clamp leg axis and the second clamp leg axis, and the first clamp leg and the second clamp leg each include a matrix of reinforcing rigid rods directed longitudinally therethrough, wherein the rigid rods of the first clamp leg extend into the first clamp base and the rigid rods of the second clamp leg extend into the second clamp base, and an upper distal end of the first clamp leg includes a first arcuate clamp leg saddle, and an upper distal end of the second clamp leg includes a second arcuate clamp leg saddle, wherein the first arcuate clamp leg saddle and the second arcuate clamp leg saddle are each of a semicylindrical configuration and are concentric relative to the utility pole axis, and the first clamp leg saddle includes a first saddle first bore and a first saddle second bore spaced apart a predetermined spacing to a parallel relationship, and the second clamp leg saddle includes a second saddle first bore and a second saddle second bore spaced apart the predetermined spacing in a parallel relationship, wherein the first saddle first bore and the second saddle first bore are coaxially aligned and the first saddle second bore and the second saddle second bore are coaxially aligned, and a first clamp rod is directed through the first saddle first bore and the second saddle first bore, and a second clamp rod is directed through the first saddle second bore and the second saddle second bore, and the first clamp leg saddle and the second clamp leg saddle include a petroleum distillate impregnated first liner and a petroleum distillate impregnated second liner respectively coextensively mounted to the first arcuate clamp saddle and to the second clamp leg saddle, wherein the first liner includes a first arcuate metallic shield extending coextensively relative to the first liner, and the second liner includes a second arcuate metallic shield mounted coextensively to the second liner, each metallic shield includes a matrix of spike members projecting exteriorly of each shield, and each spike member includes an aperture oriented concentrically of each spike, whereupon clamping of the first clamp leg saddle and the second clamp leg saddle to the utility pole effects extrusion of petroleum distillate from the first liner and the second liner through the respective first metallic shield and the second metallic shield respectively into the utility pole.

* * * * *